United States Patent [19]

Doell et al.

[11] Patent Number: 4,524,730

[45] Date of Patent: Jun. 25, 1985

[54] METHOD FOR IMPROVING FUEL EFFICIENCY AND REDUCED EMISSIONS IN INTERNAL COMBUSTION ENGINES

[75] Inventors: Brant Doell, Tulsa; John T. Wright, Broken Arrow, both of Okla.

[73] Assignee: Doellwood Financial, Inc., Tulsa, Okla.

[21] Appl. No.: 524,550

[22] Filed: Aug. 19, 1983

[51] Int. Cl.[3] ..... F02B 49/00

[52] U.S. Cl. ..... 123/27 GE; 123/525; 123/577; 261/50 A

[58] Field of Search ..... 123/525, 526, 527, 540, 123/537, 27 GE, 577, 557; 261/50 A, 36 A

[56] References Cited

U.S. PATENT DOCUMENTS

| | | | |
|---|---|---|---|
| 3,108,749 | 3/1962 | Drayer et al. | 239/102 |
| 3,278,165 | 2/1963 | Gaffney | 239/102 |
| 3,698,365 | 10/1972 | Hallberg | 123/27 GE |
| 3,733,060 | 5/1973 | Merritt | 261/DIG. 48 |
| 3,779,460 | 12/1973 | Monro | 239/102 |
| 3,925,002 | 12/1975 | Verdouw | 60/746 |
| 3,986,669 | 10/1976 | Martner | 239/102 |
| 4,003,518 | 1/1977 | Hori et al. | 239/102 |
| 4,038,348 | 7/1977 | Kompanek | 261/36 A |
| 4,151,821 | 5/1979 | Wichman et al. | 123/527 |
| 4,159,698 | 7/1979 | Berenbaum | 123/516 |
| 4,205,786 | 6/1980 | Babich et al. | 239/102 |
| 4,224,790 | 9/1980 | Crhistensen | 60/269 |
| 4,251,031 | 2/1981 | Martin et al. | 123/538 |
| 4,335,698 | 6/1982 | Stephens | 123/537 |
| 4,345,570 | 8/1982 | McNeece | 123/525 |
| 4,356,805 | 11/1982 | Kler | 123/525 |
| 4,359,861 | 11/1982 | Citelli | 60/736 |
| 4,386,593 | 6/1983 | Tibbs | 123/527 |
| 4,411,243 | 10/1983 | Hardenberg et al. | 123/525 |

FOREIGN PATENT DOCUMENTS

| | | | |
|---|---|---|---|
| 2456856 | 1/1981 | France | 123/525 |
| 791617 | 3/1958 | United Kingdom | 60/736 |

OTHER PUBLICATIONS

Boyce et al., Paper 14, Institution of Mechanical Engineers, pp. 123–132 (1970).

Krim et al., The Combustion Institute, pp. 977–991 (1981).

Bak, Design News, pp. 92–93, Mar. 9, 1981.

Purohit et al., SAE Technical Paper 800264 SAE, 1980.

Kuniyoshi et al., SAE Technical Paper 800968 SAE, 1980.

Boyce et al., 52 Journal of the Institute of Petroleum (514), pp. 300–311 (1966).

*Primary Examiner*—E. Rollins Cross

*Attorney, Agent, or Firm*—Oblon, Fisher, Spivak, McClelland & Maier

[57] ABSTRACT

A system for improving the efficiency of an internal combustion engine, and thereby improving fuel economy while reducing emissions is disclosed, which comprises providing a stream of vaporized fuel from a vaporization chamber to the air intake stream of the engine. Surprisingly, this system is suitable for use with both diesel and gasoline engines of conventional and rotary type, as well as jet engines and other internal combustion engines. Entraining about 0.05–1.0% of the total fuel consumed in the air intake stream according to this system results in a substantial improvements of fuel economy (up to 36% improvement over the same engine without the vaporization system) while reducing pollutants at least one order of magnitude below the current standards.

4 Claims, 2 Drawing Figures

METHOD FOR IMPROVING FUEL EFFICIENCY AND REDUCED EMISSIONS IN INTERNAL COMBUSTION ENGINES

BACKGROUND OF THE INVENTION

1. Field of the Invention

This invention is directed to a process and system for improving the efficiency of internal combustion engines and thereby lowering the resultant emissions while improving fuel economy. More specifically, this invention relates to a process whereby a small percentage of the fuel employed is vaporized and sent to the cylinder or combustion chamber of the engine.

2. Description of the Prior Art

It has long been known that internal combustion engines in general, and gasoline engines of all types, diesel and jet engines in particular are not 100% efficient, i.e., the total theoretical energy yield from the fuel consumed is not realized by the engine in operation. This inefficiency not only results in a severe cost, in terms of fuel consumed, for the use of the engine, but results in substantially higher emissions of pollutants such as $NO_x$ gases, hydrocarbons, and CO that is neither safe or desirable.

Accordingly, there have been repeated attempts to improve the efficiency of internal combustion engines. One particular practice that has received a great deal of attention is the replacement of a carburetor in a gasoline engine with a fuel vaporizing or fuel/air mixing device that takes over the carburetor mixing function. However, such systems are prohibitively expensive, if not physically impractical, to install in existing engines and would require extensive and expensive retooling of engine production lines in order to employ them.

An alternative that has also been proposed to improve combustion efficiency is the evaporation apparatus of U.S. Pat. No. 4,159,698. That apparatus, limited to gasoline engines and not suitable for use in non-carburetor engines, diesel engines, jet engines, etc. involves the evaporation of a portion of the fuel which is directed to the combustion cylinder through apparatus downstream of the carburetor. Although the evaporation apparatus process of this reference may reduce certain pollutants, it does not have wide applicability to any type of engine, and it is also unsuitable for improving fuel efficiency in a fuel demand situation as the evaporation apparatus cannot be adequately controlled to provide the necessary fuel vapor.

Another problem, perhaps the most serious of those encountered, is the belief that, due to their operation on different principles, a method for improving combustion efficiency in one engine would not be suitable for use in another engine. In particular, devices such as the evaporation system discussed above provide a "pre-charge" of vaporized fuel into the cylinder in which combustion takes place. Although possibly suitable for gasoline engines, it has widely been held that such preinjection would not be suitable for diesel engines, due to the problems of preignition. Diesel engines differ from gasoline engines in that air drawn into the cylinders is compressed and thus heated above autoignition temperature of the injected diesel fuel charge. In gasoline engines, gasoline and air vapor is ignited by a spark-plug and is at all times below autoignition temperatures.

When fuel/air mixtures are autoignited too early, preignition or knocking occurs, resulting in damage to the engine. Preignition or knocking can occur in diesel engines by injecting fuel through the injectors too early in the engine combustion cycle; that is, too far before the piston reaches "top-dead-center".

Accordingly, it has been widely held that fuel vapor in the intake air would cause preignition. Thus, systems designed for gasoline engines which provide fuel vapors in an air stream have not been employed, and in fact, have been deliberately avoided, in connection with diesel engines.

It is of course true that both rotary engines and jet engines provide even greater differences which must be overcome in the provision of a universally acceptable fuel vapor air intake system.

Accordingly, there continues to be a widespread need in the art for development of a system which improves the efficiency of internal combustion engines which is universally acceptable and can be retrofitted to existing engines as well as installed in new engines, without substantial expense and retooling.

SUMMARY OF THE INVENTION

It is, therefore, one object of the invention to provide a universally acceptable system for improving the efficiency of internal combustion engines.

It is another object of this invention to provide a system for providing vaporized fuel in the air intake stream which may be used with gasoline, diesel and jet engines of all varieties.

It is yet another object of this invention to provide a fuel vaporization system which increases fuel efficiency at the same time that pollutants are reduced.

As will become apparent from the detailed description provided below, these and other objects can be achieved by provision of a vaporization chamber combining a small amount of fuel (about 0.1% of the total fuel consumed) to produce a vapor which is delivered to the air intake of the engine. Whether the engine is conventional gasoline or rotary, diesel or jet, this system, operating alongside the regular fuel delivery system and employing the same fuel source, has been demonstrated to provide significant and substantial increases in fuel efficiency, while achieving dramatic reductions in resultant pollutants.

DETAILED DESCRIPTION OF THE INVENTION

This invention resides in the discovery that the provision of a small amount of vaporized fuel in the air intake stream of the combustion chamber of the engine produces dramatic increases in fuel efficiency and decreases in environmental pollution, without the need for a substitute or supplementary fuel source or substantial redesigning of existing engines. Although any number of vaporization chambers are known to those of skill in the art, one particularly suitable vaporization chamber for use in this invention is that disclosed in U.S. Pat. No. 4,335,698, issuing June 22, 1982 as a preferred vaporization chamber for use in this invention. The disclosure of that patent is incorporated herein by reference.

Briefly, without any attempt to disclose said vaporization chamber in detail, the vaporization chamber apparatus involves a chamber provided with a fuel input and air input, the output of the chamber being connected to the engine intake manifold. In the chamber itself, a small amount of fuel is vaporized, and sent as fuel vapor, to the intake manifold, where it is entrained in the air intake stream for the combustion chamber.

Figure 1:
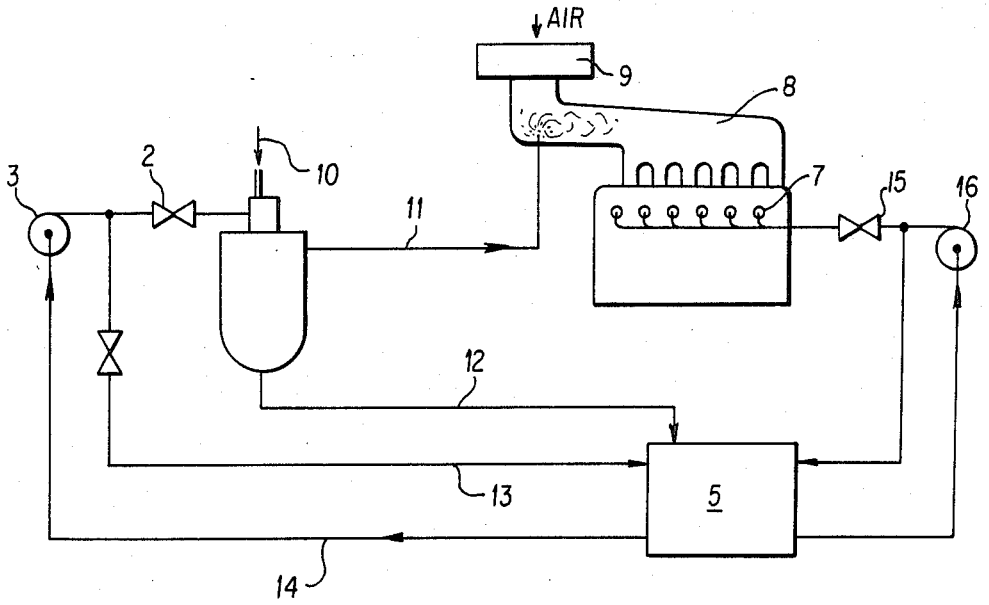
FIG. 1 is a schematic diagram of the apparatus of this system as employed in a diesel or gasoline engine, together with the regular fuel system therefore.

The use of a vaporization chamber of this type is illustrated in FIG. 1, and with reference thereto, it can be seen that the system is suitable for either diesel or gasoline engines of conventional or rotary type. As illustrated therein, fuel vapor is produced in vaporization chamber 1, which produces that vapor from fuel supply 5 through input 2 and air input 10, outputting the resultant vapor through conduit 11 into the air intake manifold 8. As will occur to those of skill in the art, the fuel supply for the vaporization chamber could also be separate.

The fuel is supplied through conduit 2 by pump 3, which is in communication through conduit 14 with the fuel tank 5 for the entire engine fuel system. As many pumps that would be used as fuel pump 3 require a constant flow of fuel to run properly, which would not necessarily be the case in providing the vapor for this invention, a relief valve 4 and fuel recirculation line 13 are also provided, as illustrated in FIG. 1. Fuel not vaporized in the vaporization chamber is also returned to the single fuel tank through return line 12.

As illustrated, this system operates side-by-side with the standard engine fuel system 16 of the internal combustion engine 6. Air is brought into the air intake manifold 8, the vapor from conduit 11 being entrained therein and thereafter distributed to the combustion chambers. The only substantial difference in the system in use in a diesel engine as opposed to a gasoline engine will be the nature of apparatus employed for providing the air, as generally this is achieved using an air cleaner and pump in a diesel engine, while gasoline engines are generally operate under a vacuum manifold system. However, as illustrated, the system of this invention can be used with both types of engines.

Although the amount of fuel vaporized and introduced into the air intake stream as a percentage of the total fuel consumed will vary from engine to engine, and engine type to engine type, generally, this percent will range between 0.05%–1% or more. A particularly preferred system, particularly for diesel and gasoline engines, uses about 0.1% of the total fuel consumed as vapor from vaporization chamber 1. In jet engines, the vaporized fuel supply may constitute the entire supply.

Figure 2:
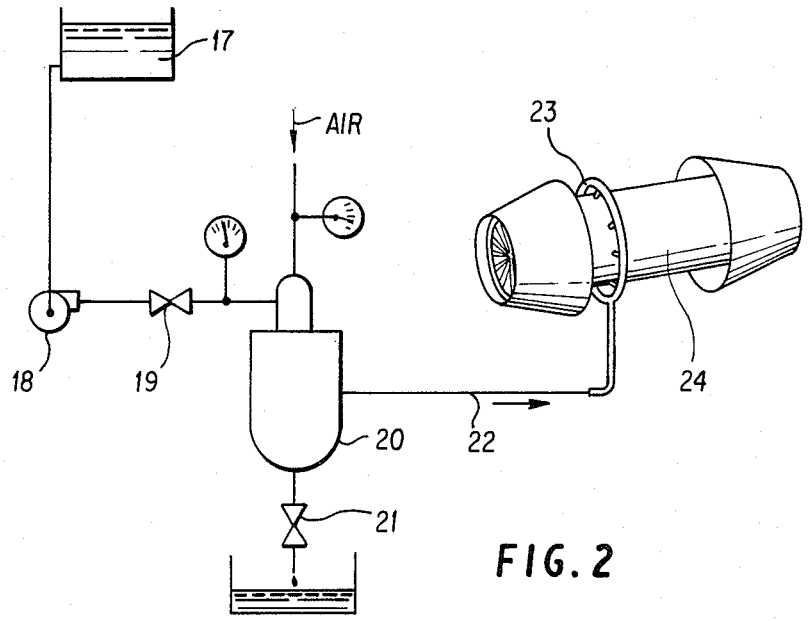
FIG. 2 is a schematic diagram of the system of this invention for providing fuel vapor to a jet engine (conventional fuel supply systems are not illustrated).

As illustrated in FIG. 2, the method and system of this invention is essentially identical with use in a jet engine, except that the vapor chamber output is fed directly to nozzle ring 23 of jet engine 24. Fuel supply 17, pump 18, valves 17 and 21, as well as vapor chamber 20 and fluid communication conduit 21 all operate in the same fashion as with respect to the corresponding features of FIG. 1. Again, the system operates on standard jet fuel, and does not require substantial modification of currently available jet engines.

The system as described above has been demonstrated in actual testing to substantially improve fuel economy, while securing significant reductions in pollutants, in internal combustion and jet engines of the type described.

TEST RESULTS

A. Fuel Economy

To demonstrate the fuel economy achieved by the improved efficiency of an engine provided with the system of this invention, a vaporization chamber was installed on an existing diesel engine substantially as illustrated in FIG. 1. Two generator sets were employed on a conventional drilling rig, allowing the running of first baseline tests on load, thereafter switching to the standby generator, installing a vapor chamber and switching the generator back on load. The diesel generator employed in this example is, in effect, an active dynamometer run at a constant speed and power output. The particular generator used for this test was identified as a product of Republic Electric and Development Company, Caterpillar 336 Generator Set. Baseline tests (i.e., controls without the vaporization generator) were run both before and after use with the vaporization chamber of the system of this invention, in order to completely justify the results. The amount of fuel consumed during these tests was determined by filling either a 30 gallon or 5 gallon tank to overflow, running the test then refilling to the same point with a measured quantity. A flow control valve was installed between the fuel tank and the fuel supply pump on the engine to restrict fuel to the engine. A Facet 416 fuel pump was used to supply diesel fuel to the vapor chamber.

In each of the runs with the vaporization system of this engine installed and operating on the diesel engine, the efficiency of the engine was dramatically improved over the baseline or control engine without vaporized fuel. In each of the runs, the diesel engine augmented by the vaporization system consumed at least one gallon of fuel less per hour of operation. On average, fuel consumption without the vaporization system of this invention is 32% worse (greater) than a diesel engine provided with vaporized fuel in the air intake stream according to this invention. Accordingly, a 24% savings in fuel cost may be expected through use of this invention in connection with diesel engines.

To further confirm the superiority of diesel engines operated in conjunction with the system of this invention, a Detroit 8V-71 diesel engine was provided with a vaporization chamber installed substantially according to FIG. 1, and tested as to its performance both before, during and after installation of the vaporization system. A dynamometer was used to load the engine and obtained the HP, RPM, fuel pressure water temperature and oil temperature during operation. The tests were conducted as follows:

1. The engine was originally run to operating temperature.
2. At the beginning of a test, the fuel tank was filled to the overflow point and a stopwatch was started.
3. As the engine ran, data was taken at intervals so that average conditions could be determined. The dynamometer/engine combination was able to hold a constant output which is why an average was required.
4. At the end of the run, the stopwatch was stopped and the fuel tank was refilled to the overflow point. This fuel was weighed to determine usage on the test run.

Again, each run with a small percentage (in this case, 0.1%) of the total fuel consumed being provided as vaporized fuel into the air intake demonstrated superior fuel efficiency as compared with baseline runs. Fuel economy improvement exhibited ranged up to 35% as compared with baseline tests. After averaging out all of the runs employing the system of this invention as opposed to the control runs, the engine, when hooked up to the vaporization chamber and used according to this invention, consumed 0.3551 pounds of fuel per horsepower hour, as compared with 0.4064 pounds of fuel per horsepower hour for a standard diesel engine without vaporized fuel in the air intake stream. This, of course, corresponds to a substantial 14% improvement in fuel economy.

As a surprising and completely unexpected advantage, the tests run with the vaporization chamber installed and operated according to the claimed invention showed a substantial drop in the water and operating temperature of the engine. Although the cause of this temperature drop is not well understood it was observed to be reproducible. Of course, lowering operating temperatures and water temperatures has a beneficial effect on the engine itself.

To further demonstrate the suitability of the system of this invention for different types of engines, a vapor chamber was installed on a Pratt and Whitney JT 15B-4 jet engine according to the illustration of FIG. 2. In the test, to demonstrate the suitability of the invention disclosed herein for use with the jet engine, the engine was run on the vapor supplied by the vaporization chamber alone, after an initial 3 minute warmup period. Standard jet fuel, JP-5, was delivered to the vaporization chamber and an air pressure of 60 pounds was also supplied. The engine ran, on the fuel vapor provided by the vaporization chamber of this invention alone, for 32.5 minutes with no apparent problems. As this was a demonstration of the suitability of the system for use with a jet engine only, no hard data as to fuel consumption and temperature was taken. However, it was observed that the engine, when hooked up to the fuel vaporization system of this invention, consumed 1/7 of the fuel that would normally have been used in a run of 32.5 minutes, and the engine was believed to run, throughout the trial, substantially cooler than in a previous run under normal conditions.

B. Pollution Reduction

As noted above, the vaporization system of this invention not only substantially improves fuel economy but equally importantly reduces environmental pollutants naturally produced by inefficient operation of an internal combustion engine. Perhaps the most serious of the pollutants produced by operation of an internal combustion engine are the oxides of nitrogen (nitrous and nitric, $NO_x$). Other pollutants which are frequently encountered and are considered damaging and hazardous either to living things or the environment in general are carbon monoxide and a wide variety of hydrocarbons.

To quantify the reduction in environmental pollutants achieved by use of the system of this invention, a 1979 Pontiac Le Mans, 301 cubic inch engine was provided with the vaporization system of this invention substantially as illustrated in FIG. 1 in conjunction with the regular carburetor. The emissions were measured both at idle ($NO_x$ 80 ppm) and at 55 mph as measured by a dynamometer ($NO_x$ 610 ppm).

The latter figure of 610 ppm $NO_x$ pollutants at 55 mph converts to 0.29 grams/vehicle mile. This figure should be compared with the law-mandated pollution maximums established by the EPA, which are generally those achieved by the domestic automobile fleet in any given year. For the years 1979–1985, the domestic automobile fleet of the United States is required to have a $NO_x$ pollutant output of 2.3 grams/vehicle mile, or nearly an order of magnitude greater than a conventional gasoline automobile engine provided with this vaporization system.

It should also be noted that during the test of the engine equipped with this invention, no measurable amounts of carbon monoxide pollutants were detected. This should be compared with EPA standards of 1.7 grams/vehicle mile for 1979–1983, and 0.8 grams/vehicle mile for 1984–85. The system of this invention also demonstrated a remarkable reduction in hydrocarbon pollutants, the equipped gasoline engine emitting a measured 2.0 ppm at 55 mph (as per dynamometer) again dramatically below existing and future EPA requirements and the standard of the domestic auto fleet.

The system for improving the efficiency of internal combustion engines of this invention has been disclosed above and described with reference to particular and preferred embodiments, as well as tests and examples which are intended to be illustrative only, and are not intended to limit the invention. Variations will occur to those of ordinary skill in the art, particularly with respect to spatial arrangement and relation of the parts of the system, amounts of fuel employed and consumed, and details as to the construction of the parts of the system without the exercise of inventive faculty. These variations remain within the scope of the invention, as claimed below.

What is claimed as new and desired to be secured by Letters Patent of the United States is:

1. A system for improving the efficiency of a diesel internal combustion engine having a principle fuel supply and delivery system comprising a means for mixing said fuel and air, and an air intake stream, thereby improving fuel efficiency and reducing pollutants therefrom, comprising:

providing, as an adjunct to said principle engine fuel supply system, vaporized fuel drawn from said principle fuel supply to said air intake stream downstream of said mixing means, whereby said vaporized fuel is distributed to at least one combustion chamber of said engine, said vaporized fuel being supplied by a vaporization chamber in fluid communication with said principle fuel supply whereby said vaporized fuel is drawn from said principle fuel supply for vaporization in said vaporization chamber.

2. The system of claim 1, wherein said vaporized fuel is from 0.05–1.0% of the total fuel consumed by said engine.

3. The system of claim 2 wherein said vaporized fuel is 0.1% of the total fuel consumed by said engine.

4. The system of claim 1, wherein said fluid communication is effected by a fuel pump capable of pumping fuels from said fuel supply to said vaporization chamber, said fuel pump being provided with a constant flow of fuel, a release valve and a fuel recirculation line to return fuel not consumed in said vaporization chamber to said fuel supply.

* * * * *